US007161545B2

(12) United States Patent
Pan

(10) Patent No.: US 7,161,545 B2
(45) Date of Patent: Jan. 9, 2007

(54) EMBEDDED ANTENNA DEVICE

(75) Inventor: Long-Jyh Pan, Shijr (TW)

(73) Assignee: BenQ Corporation, Taoyuan Shien (TW)

( * ) Notice: Subject to any disclaimer, the term of this patent is extended or adjusted under 35 U.S.C. 154(b) by 9 days.

(21) Appl. No.: 11/108,821

(22) Filed: Apr. 19, 2005

(65) Prior Publication Data

US 2005/0231431 A1 Oct. 20, 2005

(30) Foreign Application Priority Data

Apr. 19, 2004 (TW) ..... 93110893 A

(51) Int. Cl.
*H01Q 1/24* (2006.01)
*H01Q 3/02* (2006.01)

(52) U.S. Cl. ..... 343/702; 343/873; 343/882; 343/895

(58) Field of Classification Search ..... 343/873, 343/702, 895, 881, 882
See application file for complete search history.

(56) References Cited

U.S. PATENT DOCUMENTS 3,908,933 A * 9/1975 Goss et al. ..... 244/3.21
6,259,897 B1 * 7/2001 Kim ..... 455/575.7
6,272,356 B1 * 8/2001 Dolman et al. ..... 455/575.3
6,353,733 B1 * 3/2002 Murray et al. ..... 455/90.1
6,414,643 B1 * 7/2002 Cheng et al. ..... 343/702
6,903,694 B1 * 6/2005 Kim ..... 343/702

* cited by examiner

*Primary Examiner*—Trinh Vo Dinh
(74) *Attorney, Agent, or Firm*—Rabin & Berdo, PC

(57) ABSTRACT

A portable electronic apparatus with an embedded antenna module includes a main body, a flipper, and an axle having a hinge. The axle is used for connecting the main body and the flipper. The antenna module disposed in the axle is fixed to the main body. The antenna module is aligned to the hinge.

15 Claims, 3 Drawing Sheets

EMBEDDED ANTENNA DEVICE

This application claims the benefit of Taiwan Application Serial No. 093110893, filed Apr. 19, 2004, the subject matter of which is incorporated herein by reference.

BACKGROUND OF THE INVENTION

1. Field of the Invention

The invention relates in general to an antenna apparatus, and more particularly to an antenna apparatus applied in a portable electronic apparatus.

2. Description of the Related Art

With the rapid advance and development in electronic and information technology in recent years, the portable electronic apparatus has become more and more popular. Take the mobile phone for an example; slimness, lightness and compactness are still essential features of a popular model. Traditionally, the mobile phone antenna protrudes straight from the housing, so that the protruding antenna is easy to be hooked or stuck by something, such as clothes or accessory. Thus, the protruding antenna is subject to be damaged when users carelessly take the mobile phone out of the pocket or bag.

SUMMARY OF THE INVENTION

It is therefore an object of the invention to provide a portable electronic apparatus with an embedded antenna module, which reduces the size of an electronic apparatus and increase the convenience of portability.

According to an object of the invention, a portable electronic apparatus is provided and disclosed as below. The portable electronic apparatus includes a main body, a flipper, an axle and an antenna module. The axle includes a hinge for connecting the main body to the flipper. The antenna module is received in the axle and fixed to the main body, while the antenna module is aligned to the hinge.

According to another object of the invention, an embedded antenna device is provided and disclosed below. The embedded antenna device disposed in the portable electronic apparatus includes a sleeve, an antenna and a conductor. The portable electronic apparatus includes a hinge. The sleeve has a cavity and is aligned to the hinge. The antenna is disposed in the cavity. The conductor electrically connects the antenna to the portable electronic apparatus.

According to another object of the invention, an embedded antenna device is provided and disclosed below. The embedded antenna device includes a sleeve, a fixing portion, an antenna, a cam and an elastic piece. The sleeve has a first cavity. The fixing portion adjacent to the sleeve has a second cavity. The antenna is received in first cavity. The first end of the cam is inserted to the antenna, while the second end of the cam is received in the second cavity to fix the antenna in the sleeve. The elastic piece has a third end and a fourth end. The third end of the elastic piece is electrically connected with the cam, while the fourth end of the elastic piece protrudes from the fixing portion. The antenna is electrically connected to a printed circuit board (PCB) outside the sleeve by the elastic piece indirectly.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
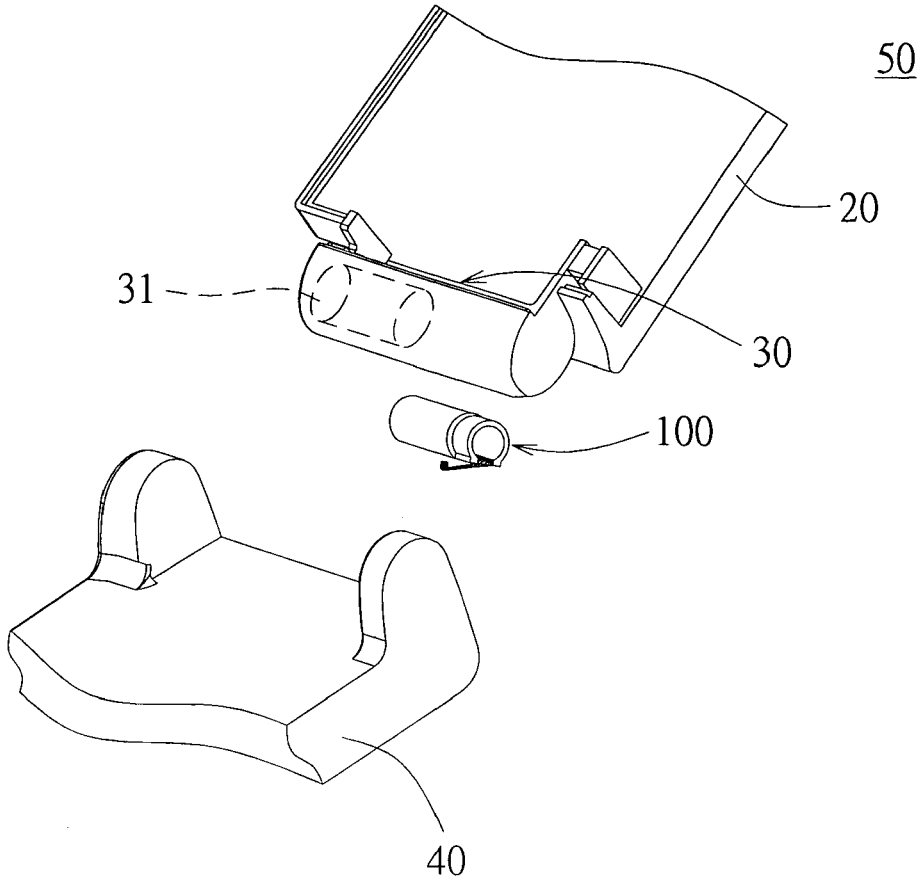
FIG. 1 schematically illustrates a perspective view of a portable electronic apparatus according to a preferred embodiment of the invention.

Referring to FIG. 1, a perspective view of a portable electronic apparatus according to a preferred embodiment of the invention is shown. The portable electronic apparatus 50 includes a main body 40, a flipper 20, an axle 30 and an antenna module 100. The axle 30 includes a hinge 31, which is used for connecting the main body 40 to the flipper 20. The antenna module 100, which is received in axle 30 and fixed to the main body 40, is aligned with the hinge 31. The portable electronic apparatus 50 is preferably to be a foldable mobile phone, a foldable personal digital assistant (PDA), a notebook computer, or any other folder-type electronic apparatuses with a flipper.

Figure 2A:
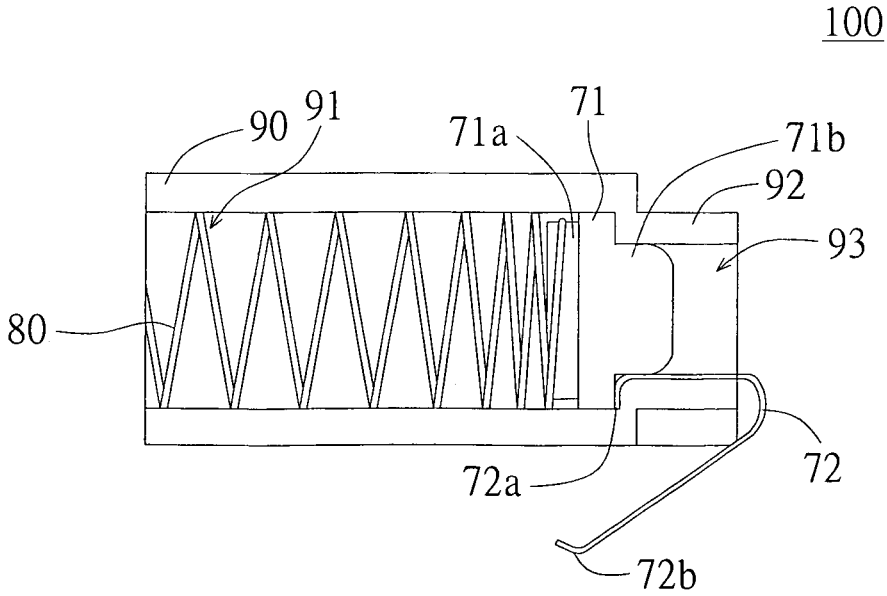
FIG. 2A schematically illustrates a cross-sectional view of the antenna module of the portable electronic apparatus in FIG. 1.

Referring to FIG. 2A, a cross-sectional view of the antenna module of the portable electronic apparatus of FIG. 1 is shown. The antenna module 100 includes a sleeve 90, an antenna 80 and a conductor. The sleeve 90 has a cavity 91, and the antenna 80 is disposed in the cavity 91. The conductor is used for electrically connecting the antenna 80 to the portable electronic apparatus 50.

Figure 2B:
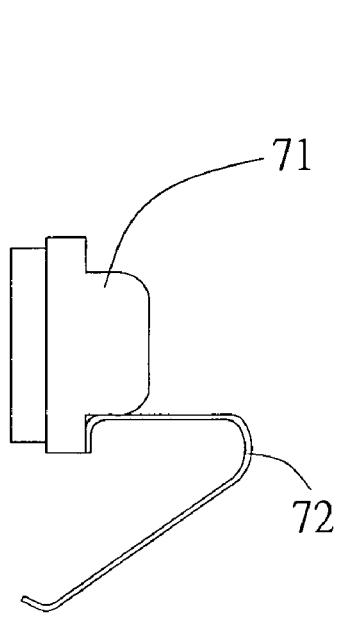
FIG. 2B schematically illustrates a side view of the conductor of the antenna module in FIG. 2A.

FIG. 2B illustrates a side view of the conductor of the antenna module in FIG. 2A. The conductor 70, for example, includes a cam 71 and an elastic piece 72. Referring to FIG. 2A, the antenna module 100 further includes a fixing portion 92, which is adjacent to the sleeve 90 and has a cavity 93. The first end 71*a* of the cam 71 is disposed in the cavity 91 of the sleeve 90 and inserted to the antenna 80, while the second end 71*b* of the cam 71 is received in the cavity 93 of the fixing portion 92 in order to fix the antenna 80 in the sleeve 90. The third end 72*a*of the elastic piece 72 is electrically connected to the cam 71, while the fourth end 72*b* of the elastic piece 72 protrudes from the fixing portion 92.

When assembling the antenna module 100, the elastic piece 72 is first laid on the bottom of the fixing portion 92. Next, the cam 71 is fit snugly into the cavity 91 of the sleeve 90, so that the cam 71 is firmly connected to the elastic piece 72 via the fixing portion 92. After that, the antenna 80 is fit into the cavity 91 of the sleeve 90, and covers the first end 71*a* of the cam 71. Owing to the interference, the antenna 80 is fixed in the sleeve 90.

Figure 3A:
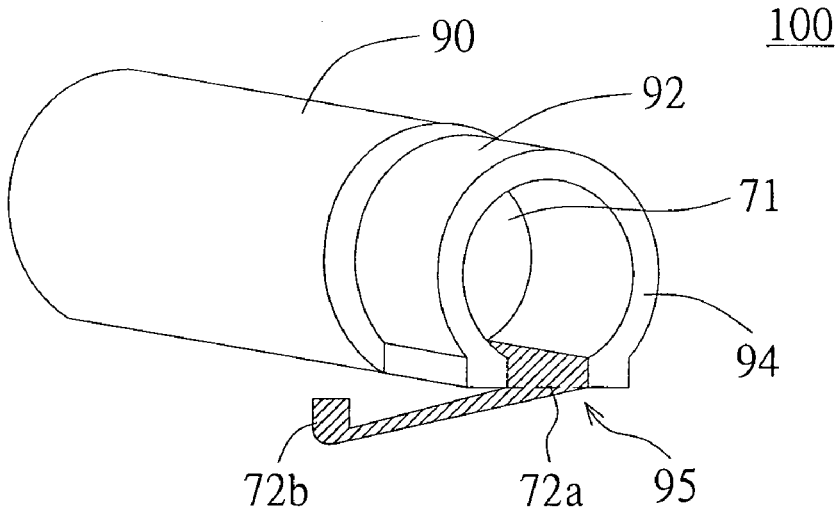
FIG. 3A schematically illustrates a perspective view of the antenna module in FIG. 2.
Figure 3B:
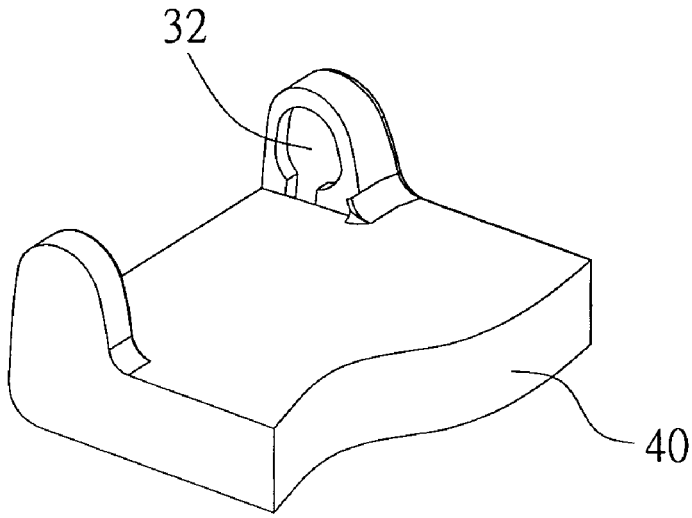
FIG. 3B schematically illustrates a partial enlargement view of the main body of the portable electronic apparatus in FIG. 1.

Referring to FIG. 3A, a perspective view of the antenna module of FIG. 2 is shown. In the antenna module 100, the fixing portion 92 has a non-circular flange 94. Besides, the fixing portion 92 has a slit 95 positioned on the non-circular flange 94, and the slit 95 is used for receiving the third end 72*a* of the elastic piece 72. Referring to FIG. 3B, a partial enlargement view of the main body of the portable electronic apparatus according to the FIG. 1 is shown. The axle 30 has a non-circular groove 32 which is positioned in the pivotal connection between the main body 40 and the axle 30. The non-circular groove 32 is further complementary to the non-circular flange 94 of the fixing portion 92. Via the interlock between the non-circular flange 94 and the non-circular groove 32, the antenna module 100 is fixed to the main body 40.

Figure 4:
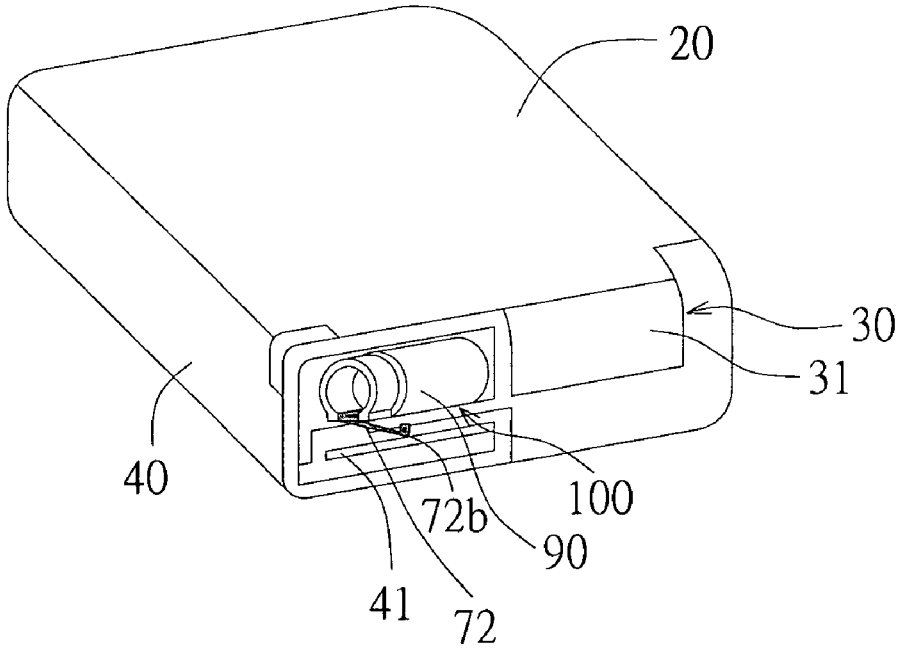
FIG. 4 schematically illustrates a partial perspective view of the axle of the portable electronic apparatus in FIG. 1.

Referring to FIG. 4, a partial perspective view of the axle of the portable electronic apparatus of FIG. 1 is shown. In the portable electronic apparatus 50, the main body 40 includes a printed circuit board 41 to which the fourth end 72*b* of the elastic piece 72 protruding from the sleeve 90 is closely connected. Thus, the antenna 80 can be electrically conducted with the printed circuit board 41 positioned outside the sleeve 90.

Besides, in the antenna module 100, the cam 71 is preferably a copper cam, while the antenna 80 is preferably a spiral antenna.

The portable electronic apparatus disclosed in the preferred embodiment of the invention comprises the antenna module embedded in the axle of the portable electronic apparatus. The embedded antenna reduced the risk from being hooked or stuck by some objects, such as clothes and accessory. Furthermore, the portable electronic apparatus with embedded antenna, which possesses the small size, is handy and portable for the user. Besides, the antenna module is easy for assembly because the elements of the antenna module are simply organized and interconnected by the interference While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An embedded antenna device disposed in a portable electronic apparatus, the portable electronic apparatus at least comprising a hinge, the embedded antenna device comprising:

a sleeve having a cavity, the sleeve being aligned with the hinge;

an antenna disposed in the cavity; and a conductor electrically connecting the antenna and the portable electronic apparatus, the conductor comprising a cam snugly fit within the cavity for fixing the antenna inside the sleeve, the cam having a first end adjacent to said antenna and a second end that protrudes away from the antenna, the first end having a diameter that is larger than a diameter of the second end, and an elastic piece having a third end and a fourth end, the third end being pressed between the second end of the cam and the sleeve in an interference fit, to electrically connect the elastic piece with the cam, the fourth end protruding from the sleeve.

2. The embedded antenna device according to claim 1, wherein the portable electronic apparatus comprises a printed circuit board, the second end of the elastic piece being closely connected to the printed circuit board.

3. The embedded antenna device according to claim 1, wherein the cam is a copper cam.

4. The embedded antenna device according to claim 1, further comprising 1 further comprises a fixing portion having a non-circular flange for fixing the sleeve to the portable electronic apparatus.

5. The embedded antenna device according to claim 4, wherein the fixing portion further has a slit positioned on the non-circular flange for holding the third end of the elastic piece.

6. The embedded antenna device according to claim 1, wherein the antenna is a spiral antenna.

7. An embedded antenna device, comprising:

a sleeve having a first cavity;

a fixing portion having a second cavity, disposed adjacent to the sleeve;

an antenna received in the first cavity;

a cam snugly fit within the first and second cavity, and having a first end and a second end, the first end having a diameter that is larger than a diameter of the second end, the first end of the cam being inserted into the antenna, the second end of the cam protruding away from the antenna and being received in the second cavity whereby the antenna is fixed in the sleeve; and an elastic piece having a third end and a fourth end, the third end of the elastic piece being pressed between the second end of the cam and the fixing portion in an interference fit to electrically connect the elastic piece with the cam, the fourth end of the elastic piece protruding from the fixing portion, wherein the antenna is electrically conducted outside the sleeve by the elastic piece.

8. The embedded antenna device according to claim 7, wherein the fixing portion has a non-circular flange.

9. The embedded antenna device according to claim 8, wherein the fixing portion has a slit positioned on the non-circular flange for holding the first end of the elastic piece.

10. The embedded antenna device according to claim 7, wherein the cam is a copper cam.

11. The embedded antenna device according to claim 7, wherein the antenna is a spiral antenna.

12. A portable electronic apparatus, comprising:

a main body;

a flipper;

an axle comprising a hinge for connecting the main body and the flipper; and an antenna module received in the axle and fixed to the main body, wherein the antenna module is aligned with the hinge, the antenna module comprising:

a sleeve having a cavity:

an antenna disposed in the cavity; and a conductor electrically connecting the antenna and the portable electronic apparatus, the conductor comprising a cam snugly fit within the cavity for fixing the antenna inside the sleeve, the cam having a first end adjacent to said antenna and a second end that protrudes away from the antenna, the first end having a diameter that is larger than a diameter of the second end, and an elastic piece having a third end and a fourth end, the third end being pressed between the second end of the cam and the sleeve in an interference fit, to electrically connect the elastic piece with the cam, the fourth end protruding from the sleeve.

13. The portable electronic apparatus according to claim 12, further comprising a printed circuit board, the fourth end of the elastic piece being closely connected with the printed circuit board.

14. The portable electronic apparatus according to claim 12, wherein the sleeve further comprises a non-circular flange, and the main body further comprises a groove, the non-circular flange being fastened to the groove for fixing the antenna module to the main body.

15. The portable electronic apparatus according to claim 14, wherein the sleeve further comprises a slit positioned on the non-circular flange for receiving the elastic piece.

* * * * *